US011181869B2

(12) United States Patent
Riedo et al.

(10) Patent No.: US 11,181,869 B2
(45) Date of Patent: Nov. 23, 2021

(54) TOOL FOR ACTUATING A CORRECTOR EQUIPPING A PORTABLE OBJECT OF SMALL DIMENSIONS

(71) Applicant: Montres Breguet S.A., L'Abbaye (CH)

(72) Inventors: Christophe Riedo, Le Lieu (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 432 days.

(21) Appl. No.: 16/104,181

(22) Filed: Aug. 17, 2018

(65) Prior Publication Data

US 2019/0072907 A1 Mar. 7, 2019

(30) Foreign Application Priority Data

Sep. 7, 2017 (EP) ..... 17189928

(51) Int. Cl.
*G04D 7/00* (2006.01)
*G04D 1/00* (2006.01)
(Continued)

(52) U.S. Cl.
CPC ..... *G04D 7/00* (2013.01); *G04B 3/02* (2013.01); *G04B 27/00* (2013.01); *G04D 1/0042* (2013.01)

(58) Field of Classification Search
None
See application file for complete search history.

(56) References Cited

U.S. PATENT DOCUMENTS 1,004,755 A 10/1911 Dunaway
3,901,298 A * 8/1975 Eby ..... B25B 23/10 81/455
(Continued)

FOREIGN PATENT DOCUMENTS

CN 1934507 A 3/2007
CN 101614175 A 12/2009
(Continued)

OTHER PUBLICATIONS

European Search Report dated Mar. 15, 2018 in European Application 17189928.9 filed on Sep. 7, 2017 (with English Translation of Categories of Cited Documents).
(Continued)

*Primary Examiner* — Brian D Keller
(74) *Attorney, Agent, or Firm* — Oblon, McClelland, Maier & Neustadt, L.L.P.

(57) ABSTRACT

The invention relates to an actuating tool for actuating a push-button corrector equipping a portable object of small dimensions, wherein said actuating tool comprises a body that extends between a rear end that defines an area for grasping the actuating tool and a front end that defines an area for actuating the actuating tool, wherein the actuating tool further comprises an actuating rod that extends inwards relative to the body and that ends, towards the front end of the body, in an actuating portion, and the actuating tool finally comprises a guide sleeve that surrounds the actuating portion of the actuating tool and that is capable of moving between a first protruding position wherein the actuating portion is at most flush with the guide sleeve, and a second position wherein it is at least partially retracted inside the body, in which position the actuating portion is capable of actuating the push-button corrector.

20 Claims, 2 Drawing Sheets

(51) Int. Cl.
*G04B 3/02* (2006.01)
*G04B 27/00* (2006.01)

(56) References Cited

U.S. PATENT DOCUMENTS

| | | | | |
|---|---|---|---|---|
| 4,763,548 | A * | 8/1988 | Leibinger | A61B 17/8891 81/438 |
| 2019/0072906 | A1* | 3/2019 | Riedo | G04B 3/02 |

FOREIGN PATENT DOCUMENTS

| | | | |
|---|---|---|---|
| CN | 101886725 | A | 11/2010 |
| CN | 101910682 | A | 12/2010 |
| CN | 102307604 | A | 1/2012 |
| CN | 202205932 | U | 4/2012 |
| CN | 103765017 | A | 4/2014 |
| CN | 104466484 | | 3/2015 |

OTHER PUBLICATIONS

Combined Chinese Office Action and Search Report dated Jun. 16, 2020 in Patent Application No. 201811024856.7 (with partial English language translation and English translation of Category of Cited Documents), 10 pages.

* cited by examiner

TOOL FOR ACTUATING A CORRECTOR EQUIPPING A PORTABLE OBJECT OF SMALL DIMENSIONS

This application claims priority from European Patent Application No. 17189928.9 filed on Sep. 7, 2017, the entire disclosure of which is hereby incorporated herein by reference.

TECHNICAL FIELD OF THE INVENTION

The present invention relates to a tool for actuating a corrector equipping a portable object of small dimensions, such as a timepiece. The invention more particularly relates to a tool for actuating a push-button of small dimensions, known as a corrector, commonly equipping portable objects such as wristwatches with numerous complications, or smart phones.

TECHNOLOGICAL BACKGROUND OF THE INVENTION

Some watches, in particular so-called watches with numerous complications, offer users so many functions that they cannot all be corrected using a single winding and correcting crown. This is why such watches comprise additional control means such as push-buttons. Different types of push-buttons exist, including miniature push-buttons that are generally embedded in the middle of the watch and that are usually actuated using a pointed instrument. These miniature push-buttons conventionally comprise a socket driven, bonded or screwed into an opening made in the middle of the watch, and a cylindrical control rod capable of sliding freely within the socket. The socket comprises, on the outer side of the watch case, a first cylindrical passage adapted to suit the dimensions of a first portion of the control rod, and on the inner side of the watch case, a second cylindrical passage arranged in the continuation of the first cylindrical passage, whose inner diameter, which is adapted to suit the dimensions of a second portion of the control rod, is less than that of the first cylindrical passage. A water-resistant joint housed in a groove made on a perimeter of the first portion of the control rod guarantees the water-tight seal between the control rod and the socket. Such a push-button further comprises a helical spring, which is compressed when the user presses on the miniature push-button, and whose return force brings the control rod back to the rest position when the user releases pressure on the push-button.

Push-buttons of the aforementioned type have very small dimensions. Such push-buttons therefore save space. Moreover, they do not project from the middle and therefore do not risk being actuated by accident. Correction operations take place by driving the control rod into the socket against the return force of the helical spring using a pointed instrument such as a pen. The aforementioned point poses a problem. Indeed, as stated hereinabove, such push-buttons usually equip wristwatches with numerous complications. These are extremely expensive watches, the cases thereof being often made using precious materials. However, the risks of damaging the watch case and of altering the aesthetic appearance thereof when handling a pointed instrument are high, which has become difficult to accept. Of course, there is still the possibility of returning the watch to a workshop for re-polishing, but this is not very convenient.

Push-buttons of the aforementioned type are also used on other portable objects of small dimensions such as smartphones, and the actuation thereof is often used to reset the telephone's electronic circuits.

SUMMARY OF THE INVENTION

The purpose of the present invention is to overcome drawbacks including the aforementioned problems by providing a tool suitable for use by horologists, but primarily intended for the persons wearing the watches and allowing small push-buttons, also known as correctors, to be actuated without the risk of damaging the middle of the watch case. The tool according to the invention can also be used to actuate the correctors equipping, for example, smartphones which are used, for example, to reset the telephone's electronic circuits.

For this purpose, the present invention relates to a tool for actuating a push-button corrector equipping a portable object of small dimensions, said actuating tool comprising a body that extends between a rear end defining an area for grasping the actuating tool and a front end defining an actuating area of the actuating tool, whereby the actuating tool further comprises an actuating rod that extends inwards relative to the body and that ends, towards the front end of the body, in an actuating portion, the actuating tool finally comprising a guide sleeve that surrounds the actuating portion of the actuating rod and that is capable of moving between a first protruding position wherein the actuating portion is at most flush with the guide sleeve, and a second position wherein it is at least partially retracted inside the body, the path of the guide sleeve between the first retracted position thereof and the second at least partially retracted position thereof being sufficient to allow the actuating portion to be capable of actuating the push-button corrector.

According to specific embodiments of the invention:

- the body comprises a cap arranged in a fixed manner on the actuating rod, the guide sleeve being positioned between the cap and the actuating rod on the side of the front end of the body;
- the cap delimits, with the actuating rod, a cylindrical housing inside which the guide sleeve, positioned in a coaxial manner about the actuating rod, is capable of moving from front to back and from back to front under the effect of a helical spring threaded on the actuating rod;
- the helical spring bears against the guide sleeve on the side of the front end, and against a shoulder formed on the actuating rod on the side of the rear end;
- the actuating portion of the actuating rod projects from the cap, the guide sleeve being capable of moving between a protruding rest position wherein an end portion thereof fully surrounds the actuating portion of the actuating rod, and a retracted working position wherein the end portion is retracted inside the cap;
- the actuating rod comprises a first cylindrical portion with a first diameter and a second cylindrical portion with a second diameter that is less than the first diameter, the actuating portion being formed by a third cylindrical portion with a third diameter that is less than the second diameter, the cap being arranged in a fixed manner on the second cylindrical portion of the actuating rod and delimiting, with the third cylindrical portion of the actuating rod, the cylindrical housing inside which the guide sleeve is positioned in a coaxial manner about the third cylindrical portion of the actuating rod, the helical spring being threaded on the third cylindrical portion of the actuating rod and bearing against the guide sleeve at a front end, and against a shoulder formed by the second cylindrical portion of the actuating rod at a rear end, the third cylindrical portion projecting from the cap at the front end of the actuating tool and being surrounded by the end portion of the guide sleeve, which is also cylindrical.

Thanks to these characteristics, the present invention provides a tool that allows for the actuation of corrector-type push-buttons, i.e. buttons embedded in a middle of a portable object such as a watch, in particular a watch with numerous complications, or a smartphone, without the risk of damaging the middle of the portable object. More specifically, when at rest, the actuating rod is in a situation wherein the front end thereof that defines a portion for actuating a corrector is at most flush with a guide sleeve surrounding it. As a result, when looking to actuate a corrector using the actuating tool according to the invention, said tool is brought close to the corrector and is applied, via the corrector sleeve thereof, against the middle of the portable object. At this stage, there is no risk of damaging the middle of the portable object as the actuating portion is retracted from or at most flush with the guide sleeve. Then, once the actuating tool is pressed against the middle of the portable object, said tool is gently pushed, which results in passing the guide sleeve from the first position thereof, wherein it surrounds the actuating portion of the actuating rod, to the second position thereof, wherein it is at least partially retracted inside the body, in which position the actuating portion is capable of actuating the push-button corrector. Once the corrector has been actuated, the pressure applied to the actuating tool is released, which allows the guide sleeve to return to the first position thereof, wherein it fully surrounds the actuating portion of the actuating rod.

According to another advantage of the invention, the guide function of the tool, provided by the guide sleeve that surrounds the actuating rod and that bears against the outer circumference of the push-button corrector, is separated from the actual actuating function of the tool, which is performed by the actuating rod, which significantly eases the positioning and use of the actuating tool.

It is thus understood that the actuating portion that constitutes the active element of the actuating tool moves from a resting state wherein it is surrounded by the guide sleeve, to a working state wherein it allows the corrector to be actuated. The actuating rod, and thus the actuating portion, are fixed, and the guide sleeve is capable of moving between a protruding rest position wherein the end portion thereof fully surrounds the actuating portion of the actuating rod, and an at least partially retracted working position wherein the actuating portion of the actuating rod is liberated.

BRIEF DESCRIPTION OF THE FIGURES

Other characteristics and advantages of this invention shall be better understood upon reading the following detailed description of one example embodiment of an actuating tool according to the invention, said example being provided for the purposes of illustration only and not intended to limit the scope of the invention, given with reference to the accompanying drawing, wherein.

DETAILED DESCRIPTION OF ONE EMBODIMENT OF THE INVENTION

The present invention is based on the general inventive idea consisting of providing an actuating tool for actuating a push-button of the corrector type embedded in the middle of a portable object such as a wristwatch with complications or a smartphone, without the risk of damaging the middle of the portable object which, in particular in the case of wristwatches, is very often made of a precious material. In order to achieve this objective, this invention concerns using an actuating tool, the active portion whereof is surrounded by a guide sleeve in the rest position. The actuating tool can thus be positioned facing the push-button corrector without the risk of damaging the middle of the portable object. Once the tool has been properly positioned facing the push-button corrector, the corrector tool is gently pushed, which causes the guide sleeve to at least partially retract inside the body of the actuating tool and allows the active portion of the actuating tool to correct the push-button corrector.

Figure 1:
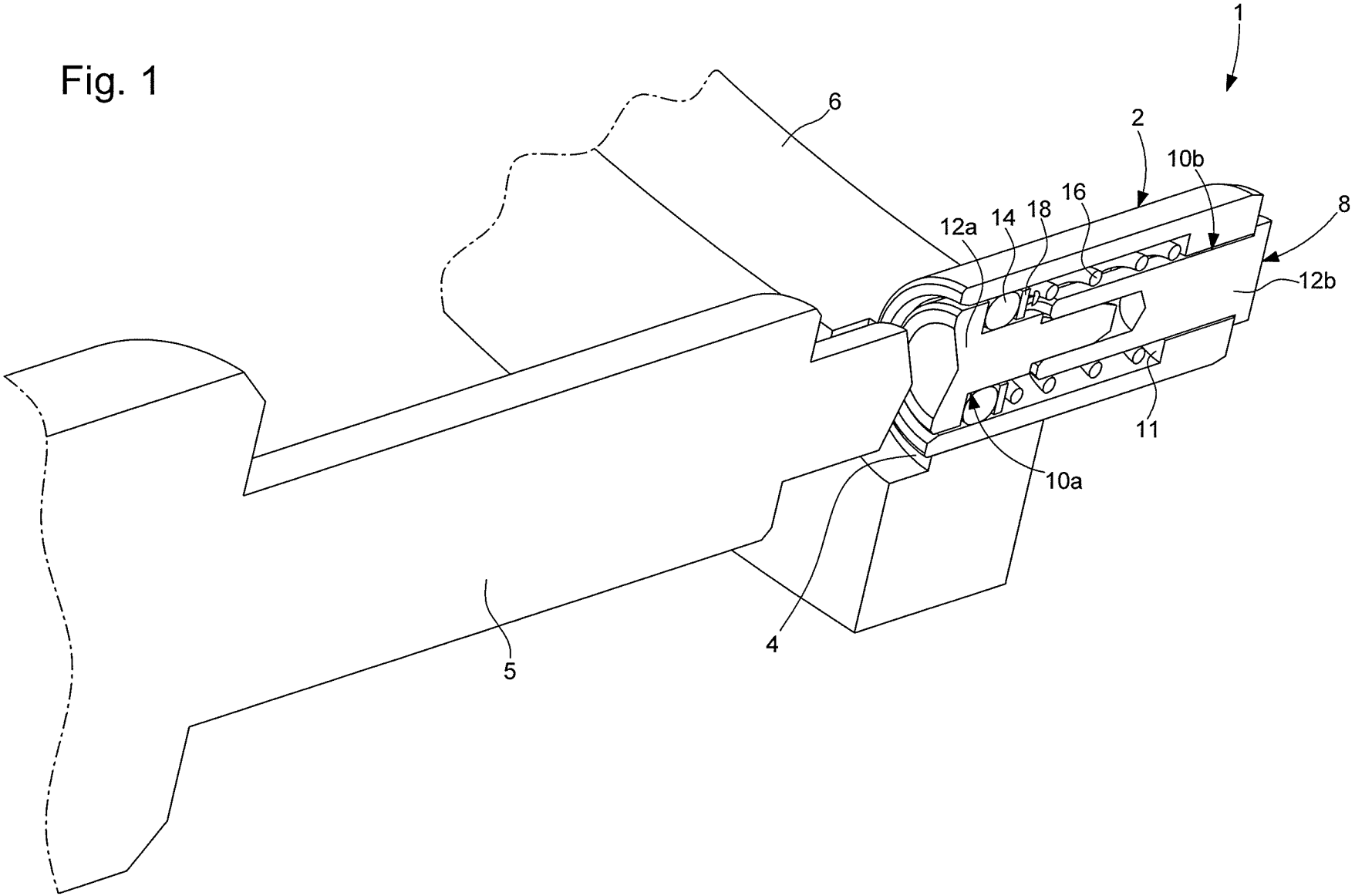
FIG. 1 is a perspective, sectional view of a push-button of the corrector type embedded in a middle of a portable object such as a wristwatch with complications.

FIG. 1 is a perspective view of one embodiment of a push-button of the corrector type, whose actuation can be performed using an actuating tool according to the invention. However, it is understood that the description of such a push-button corrector is provided for the purposes of illustration only and is not intended to limit the scope of the invention. This is a push-button corrector of the conventional type, whose structure does not require any modification or adaptation to suit the structure of the actuating tool according to the invention. Conversely, the characteristics of the push-button correctors do not affect the arrangement of the actuating tool according to the invention.

Denoted as a whole by the general reference numeral 1, a push-button of the corrector type conventionally comprises a socket 2, for example driven or bonded inside an opening 4 made in a middle 6 of a portable object, for example a wristwatch, the middle thereof being made from a precious material, or a smartphone. Said push-button corrector 1 can be actuated by the user by means of a pointed instrument 5.

A cylindrical control rod 8 is capable of sliding in the socket 2. For this purpose, the socket 2 comprises a first cylindrical passage 10*a* that opens out onto the outer side of the middle 6 of the portable object and that is adapted to suit the dimensions of a first portion 12*a* of the control rod 8. On the inner side of the case 6, the socket 2 comprises a second cylindrical passage 10*b* arranged in the continuation of the first cylindrical passage 10*a* and that defines a shoulder 11 inside the socket 2. The inner diameter of said second cylindrical passage 10*b*, adapted to suit the dimensions of a second portion 12*b* of the control rod 8, is less than that of the first cylindrical passage 10*a*. A water-resistant joint 14 housed in a groove made on a perimeter of the first portion 12*a* of the control rod 8 guarantees the water-tight seal between the control rod 8 and the socket 2. Such a push-button corrector 1 further comprises a helical spring 16, which is compressed when the user presses on the push-button corrector 1, and whose return force brings the control rod 8 back to the rest position when the user releases pressure on the push-button corrector 1. The helical spring 16 bears against a washer 18 mounted in a fixed manner on the first portion 12*a* of the control rod 8 at one end, and against the shoulder 11 at the other end.

Push-buttons of the aforementioned type have very small dimensions. They thus save space. Moreover, they do not project from the middle and therefore do not risk being actuated by accident. Such push-buttons often equip top-range watches referred to as having numerous complications. Correction operations take place using a pointed instrument such as a pen. However, the aforementioned point poses a problem. More specifically, wristwatches with complications are extremely expensive watches, the watch cases thereof being often made using precious materials. However, the risks of damaging the watch case and of altering the aesthetic appearance thereof when handling a pointed instrument are high, which has become difficult to accept.

Figure 2A:
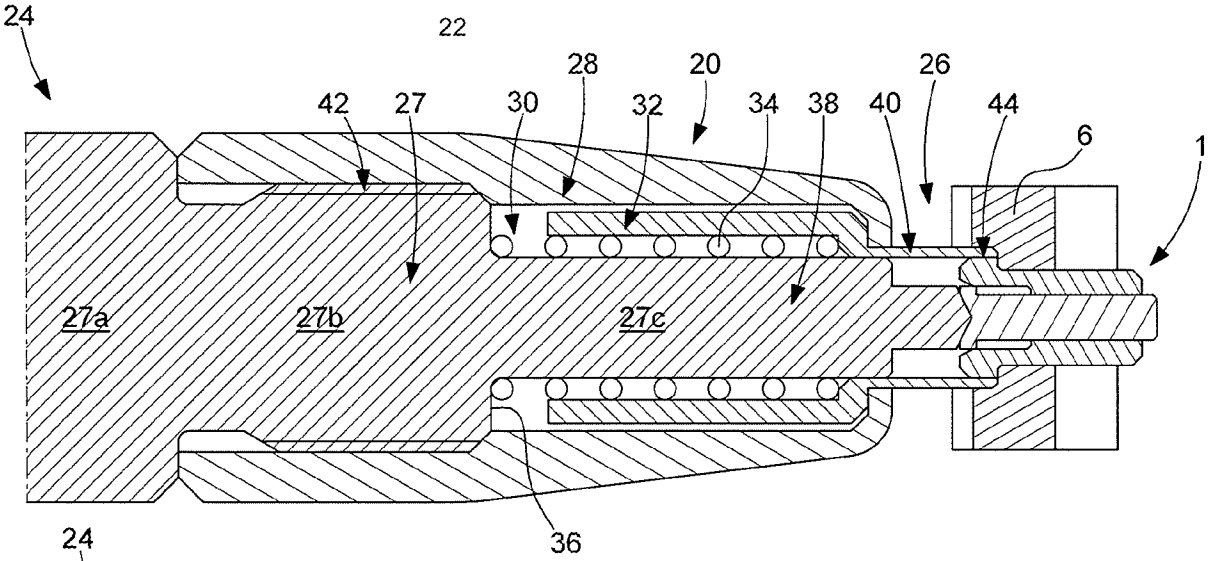
FIG. 2A is a longitudinal, sectional view of an actuating tool according to the invention in the rest position.
Figure 2B:
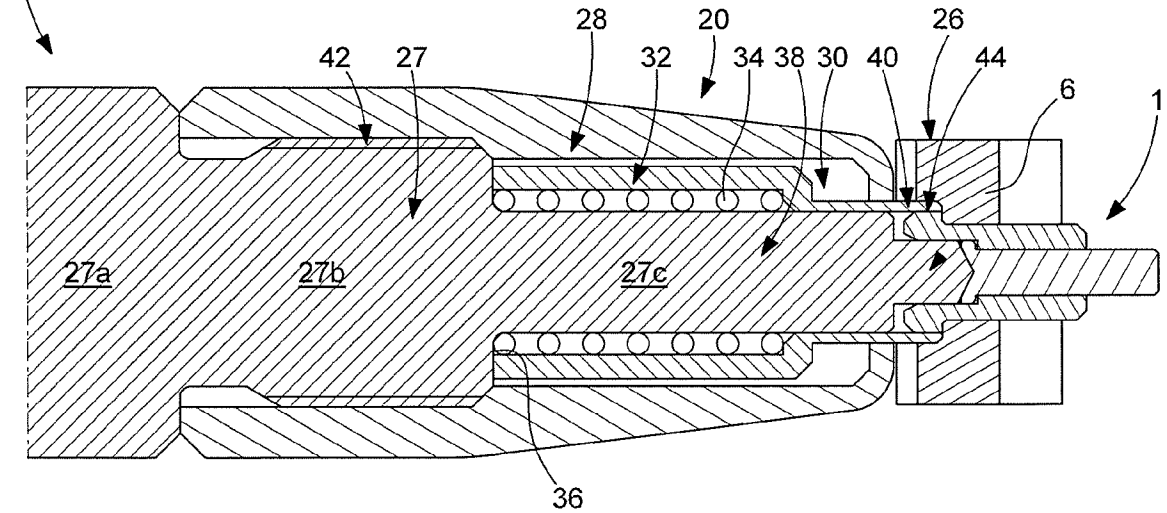
FIG. 2B is a similar view to that in FIG. 2A, wherein the actuating tool is in the working position.

In order to overcome this problem, this invention provides a tool for actuating a push-button corrector, one embodiment thereof being shown in FIGS. 2A and 2B. Denoted as a whole by the general reference numeral 20, the actuating tool comprises a body 22, the overall shape thereof being cylindrical in a non-limiting manner, which extends between a rear end 24 defining an area for grasping the actuating tool 20, and a front end 26 defining an area for actuating the actuating tool 20.

The actuating tool 20 further comprises an actuating rod 27 which extends inside the body 22 and on which a cap 28 is arranged in a fixed manner. Said cap 28 delimits, with the actuating rod 27, a cylindrical housing 30 inside which a guide sleeve 32, positioned in a coaxial manner about the actuating rod 27, is capable of moving from front to back and from back to front under the effect of a helical spring 34 threaded on the actuating rod 27. As shown in FIGS. 2A and 2B, the helical spring 34 bears against the guide sleeve 32 at a front end 26, and against a shoulder 36 formed on the actuating rod 27 at a rear end 24.

Finally, the actuating rod 27 comprises, at the front end thereof, an actuating portion 38 that projects from the cap 28 at the front end 26 of the actuating tool 20. Said actuating portion 38 constitutes the active element of the actuating tool 20 via which the push-button corrector 1 is actuated. The guide sleeve 32 is capable of moving between a protruding rest position (FIG. 2A) wherein the guide sleeve 32 is forced outwards relative to the cap 28 by the helical spring 34, and a retracted working position (FIG. 2B) wherein the guide sleeve 32 is at least partially pushed back inside the cap 28 against the elastic force of the helical spring 34. As seen upon examining FIGS. 2A and 2B, an end portion 40 of the guide sleeve 32 fully surrounds the actuating portion 38 of the actuating rod 27 in the rest position, whereas said actuating portion 38 is liberated from the end portion 40 of the guide sleeve 32 in the retracted working position.

More specifically, when the actuating tool 20 is at rest and when looking to actuate the push-button corrector 1, said actuating tool 20 is firstly brought close to the push-button corrector 1 and the end portion 40 of the guide sleeve 32 is applied against the middle 6 of the portable object (FIG. 2A). Then, under the effect of a pushing force exerted on the actuating tool 20, the guide sleeve 32 retracts inside the cap 28, which liberates the actuating portion 38 and results in the actuation of the push-button corrector 1. When the correction has been made, the actuating tool 20 is withdrawn and, under the effect of the elastic return force of the helical spring 34, the guide sleeve 32 projects back out from the cap 28 and surrounds the actuating portion 38 of the actuating rod 27.

According to one specific embodiment of the invention shown in FIGS. 2A and 2B, the actuating rod 27 comprises a first cylindrical portion 27*a* with a first diameter, and a second cylindrical portion 27*b* with a second diameter that is less than the first diameter. The actuating portion 38 is formed by a third cylindrical portion 27*c* with a third diameter that is less than the second diameter.

As shown in the figures, the cap 28 is arranged in a fixed manner, for example using a threading 42, on the second cylindrical portion 27*b* of the actuating rod 27 and delimits, with the third cylindrical portion 27*c* of the actuating rod 27, the cylindrical housing 30 inside which the guide sleeve 32 is positioned in a coaxial manner about the third cylindrical portion 27*c* of the actuating rod 27.

The helical spring 34 is threaded on the third cylindrical portion 27*c* of the actuating rod 27 and bears against the guide sleeve 32 at a front end, and against the shoulder 36 formed by the junction between the second cylindrical portion 27*b* and the third cylindrical portion 27*c* of the actuating rod 27 at a rear end. The third cylindrical portion 27*c* projects from the cap 28 at the front end 26 of the actuating tool 20 and is surrounded by the end portion 40 of the guide sleeve 32, which is also cylindrical.

It is evident that the present invention is not limited to the embodiment described above and that various simple alternatives and modifications can be considered by one of ordinary skill in the art without departing from the scope of the invention as defined by the accompanying claims. In particular, it is understood in the example described hereinabove that the guide sleeve 32 retracts far enough into the cap 28 in the working position to allow the actuating portion 38 of the actuating rod 27 to be released from the guide sleeve 32. However, this condition is not compulsory and it is understood that the path of the guide sleeve 32 between the protruding rest position thereof and the at least partially retracted working position thereof need only be sufficient to allow the actuating rod 27 to actuate the control rod 8 of the push-button corrector 1. It should also be noted that, according to one specific embodiment of the invention, at least the end of the actuating portion 38 of the actuating rod 27 will be coated in a layer of a material that is not as hard as the material of which the middle 6 of the portable object is made, for example. Finally, it should be noted that the head of the push-button correctors is often surrounded by a circular groove 44 (see FIGS. 2A and 2B) machined in the middle 6 of the portable object. According to one advantageous embodiment of the invention, the diameter of the guide sleeve 32 will correspond to the diameter of the circular groove 44.

NOMENCLATURE

1. Push-button corrector
2. Socket
4. Opening
5. Pointed instrument
6. Middle
8. Control rod
10*a*. First cylindrical passage
10*b*. Second cylindrical passage
11. Shoulder
12*a*. First portion
12*b*. Second portion
14. Water-resistant joint
16. Helical spring
18. Washer
20. Actuating tool
24. Rear end
26. Front end
27. Actuating rod
27*a*. First cylindrical portion

27*b*. Second cylindrical portion
27*c*. Third cylindrical portion
28. Cap
30. Cylindrical housing
32. Guide sleeve
34. Helical spring
36. Shoulder
38. Actuating portion
40. End portion
42. Threading
44. Groove

What is claimed is:

1. An actuating tool for actuating a push-button corrector equipping a portable object of small dimensions, said actuating tool comprising:

a body that extends between a rear end that defines an area for grasping the actuating tool and a front end that defines an actuating area of the actuating tool;

an actuating rod that extends inwards relative to the body, the actuating rod having a first end and a second end, the second end ending towards the front end of the body and the second end being an actuating portion of the actuating rod; and a guide sleeve that surrounds the actuating portion of the actuating tool, the guide sleeve being configured to move between a first protruding position wherein the actuating portion is at most flush with the guide sleeve, and a second position wherein the guide sleeve is at least partially retracted inside the body, in which position the actuating portion is capable of actuating the push-button corrector, wherein in each of the first protruding position and the second position, the first end of the actuating rod and the second end of the actuating rod are fixed with respect to each other.

2. The actuating tool according to claim 1, wherein the body comprises a cap arranged in a fixed manner on the actuating rod, and the guide sleeve is positioned between the cap and the actuating rod on a side of the front end of the body.

3. The actuating tool according to claim 2, wherein the cap delimits, with the actuating rod, a cylindrical space inside which the guide sleeve, positioned in a coaxial manner about the actuating rod, is capable of moving from front to back and from back to front under the effect of a helical spring threaded on the actuating rod.

4. The actuating tool according to claim 3, wherein the helical spring bears against the guide sleeve on the side of the front end, and against a shoulder formed on the actuating rod on the side of the rear end.

5. The actuating tool according to claim 4, wherein the actuating portion of the actuating rod projects from the cap, and the guide sleeve is capable of moving between a protruding rest position wherein an end portion thereof fully surrounds the actuating portion of the actuating rod, and a retracted working position wherein the end portion is retracted inside the cap.

6. The actuating tool according to claim 5, wherein the actuating rod comprises a first cylindrical portion with a first diameter and a second cylindrical portion with a second diameter that is less than the first diameter, and the actuating portion is formed by a third cylindrical portion with a third diameter that is less than the second diameter, wherein the cap is arranged in a fixed manner on the second cylindrical portion of the actuating rod and delimits, with the third cylindrical portion of the actuating rod, the cylindrical housing inside which the guide sleeve is positioned in a coaxial manner about the third cylindrical portion of the actuating rod, and wherein the helical spring is threaded on the third cylindrical portion of the actuating rod and bears against the guide sleeve at a front end, and against a shoulder formed by the second cylindrical portion of the actuating rod at a rear end, and the third cylindrical portion projects from the cap at the front end of the actuating tool and is surrounded by the end portion of the guide sleeve, which is also cylindrical.

7. The actuating tool according to claim 4, wherein the actuating rod comprises a first cylindrical portion with a first diameter and a second cylindrical portion with a second diameter that is less than the first diameter, and the actuating portion is formed by a third cylindrical portion with a third diameter that is less than the second diameter, wherein the cap is arranged in a fixed manner on the second cylindrical portion of the actuating rod and delimits, with the third cylindrical portion of the actuating rod, the cylindrical housing inside which the guide sleeve is positioned in a coaxial manner about the third cylindrical portion of the actuating rod, and wherein the helical spring is threaded on the third cylindrical portion of the actuating rod and bears against the guide sleeve at a front end, and against a shoulder formed by the second cylindrical portion of the actuating rod at a rear end, and the third cylindrical portion projects from the cap at the front end of the actuating tool and is surrounded by the end portion of the guide sleeve, which is also cylindrical.

8. The actuating tool according to claim 3, wherein the actuating portion of the actuating rod projects from the cap, and the guide sleeve is capable of moving between a protruding rest position wherein an end portion thereof fully surrounds the actuating portion of the actuating rod, and a retracted working position wherein the end portion is retracted inside the cap.

9. The actuating tool according to claim 8, wherein the actuating rod comprises a first cylindrical portion with a first diameter and a second cylindrical portion with a second diameter that is less than the first diameter, and the actuating portion is formed by a third cylindrical portion with a third diameter that is less than the second diameter, wherein the cap is arranged in a fixed manner on the second cylindrical portion of the actuating rod and delimits, with the third cylindrical portion of the actuating rod, the cylindrical housing inside which the guide sleeve is positioned in a coaxial manner about the third cylindrical portion of the actuating rod, and wherein the helical spring is threaded on the third cylindrical portion of the actuating rod and bears against the guide sleeve at a front end, and against a shoulder formed by the second cylindrical portion of the actuating rod at a rear end, and the third cylindrical portion projects from the cap at the front end of the actuating tool and is surrounded by the end portion of the guide sleeve, which is also cylindrical.

10. The actuating tool according to claim 3, wherein the actuating rod comprises a first cylindrical portion with a first diameter and a second cylindrical portion with a second diameter that is less than the first diameter, and the actuating portion is formed by a third cylindrical portion with a third diameter that is less than the second diameter, wherein the cap is arranged in a fixed manner on the second cylindrical portion of the actuating rod and delimits, with the third cylindrical portion of the actuating rod, the cylindrical housing inside which the guide sleeve is positioned in a coaxial manner about the third cylindrical portion of the actuating rod, and wherein the helical spring is threaded on the third cylindrical portion of the actuating rod and bears against the guide sleeve at a front end, and against a shoulder formed by the second cylindrical portion of the actuating rod at a rear end, and the third cylindrical portion projects from the cap at the front end of the actuating tool and is surrounded by the end portion of the guide sleeve, which is also cylindrical.

11. The actuating tool according to claim 2, wherein the cap is screwed onto the first cylindrical portion of the actuating rod.

12. The actuating tool according to claim 1, wherein the actuating tool is configured to engage the push-button corrector of the portable object, and wherein at least an end of the actuating portion of the actuating rod is coated in a layer of a material that is not as hard as a material of a middle of the portable object.

13. The actuating tool according to claim 1, wherein the actuating tool is configured to engage the push-button corrector of the portable object, and wherein the push-button corrector is surrounded by a circular groove machined in the portable object, wherein a diameter of the guide sleeve corresponds to a diameter of the circular groove.

14. An actuating tool for actuating a push-button corrector equipping a portable object of small dimensions, said actuating tool comprising:

a body that extends between a rear end that defines an area for grasping the actuating tool and a front end that defines an actuating area of the actuating tool;

an actuating rod that extends inwards relative to the body, the actuating rod having a first end and a second end, the second end ending towards the front end of the body, the second end being in an actuating portion of the actuating rod; and a guide sleeve that surrounds the actuating portion of the actuating tool, the guide sleeve being configured to move between a first protruding position wherein the actuating portion is at most flush with the guide sleeve, and a second position wherein the guide sleeve is at least partially retracted inside the body, in which position the actuating portion is capable of actuating the push-button corrector wherein the actuating rod comprises a first cylindrical portion with a first diameter, a second cylindrical portion with a second diameter that is less than the first diameter, and the actuating portion is formed by a third cylindrical portion with a third diameter that is less than the second diameter, wherein the guide sleeve is positioned in a coaxial manner about the actuating rod, and is configured to move from front to back and from back to front under the effect of a helical spring threaded on the actuating rod, and wherein the helical spring is threaded on and in direct contact with the third cylindrical portion of the actuating rod and bears against the guide sleeve at a front end, and against a shoulder formed by the second cylindrical portion of the actuating rod at a rear end.

15. The actuating tool according to claim 14, wherein the body comprises a cap arranged in a fixed manner on the actuating rod, and the guide sleeve is positioned between the cap and the actuating rod on a side of the front end of the body.

16. The actuating tool according to claim 15, wherein the cap delimits, with the actuating rod, a cylindrical space inside which the guide sleeve, positioned in a coaxial manner about the actuating rod, is capable of moving from front to back and from back to front under the effect of the helical spring threaded on the actuating rod.

17. The actuating tool according to claim 16, wherein the helical spring bears against the guide sleeve on the side of the front end, and against a shoulder formed on the actuating rod on the side of the rear end.

18. The actuating tool according to claim 17, wherein the actuating portion of the actuating rod projects from the cap, and the guide sleeve is capable of moving between a protruding rest position wherein an end portion thereof fully surrounds the actuating portion of the actuating rod, and a retracted working position wherein the end portion is retracted inside the cap.

19. The actuating tool according to claim 16, wherein the actuating portion of the actuating rod projects from the cap, and the guide sleeve is capable of moving between a protruding rest position wherein an end portion thereof fully surrounds the actuating portion of the actuating rod, and a retracted working position wherein the end portion is retracted inside the cap.

20. The actuating tool according to claim 16, wherein the cap is arranged in a fixed manner on the second cylindrical portion of the actuating rod and delimits, with the third cylindrical portion of the actuating rod, the cylindrical housing inside which the guide sleeve is positioned in a coaxial manner about the third cylindrical portion of the actuating rod, and wherein third cylindrical portion projects from the cap at the front end of the actuating tool and is surrounded by the end portion of the guide sleeve, which is also cylindrical.

* * * * *